US005191905A

United States Patent [19]

Tsukamoto

[11] Patent Number: 5,191,905

[45] Date of Patent: Mar. 9, 1993

[54] FILTER CIGARETTE HAVING FILTER CONTAINING ABSORPTIVE SYNTHETIC GRAFT POLYMER FIBERS PRODUCED FROM IRRADIATED POLYETHYLENE REACTED WITH VAPOR PHASE STYRENE OR ABSORPTIVE SYNTHETIC MAGNETIC FIBERS

[75] Inventor: Kenkichi Tsukamoto, Tokyo, Japan

[73] Assignee: Costarica Sogo Kaihatsu Co., Ltd., Tokyo, Japan

[21] Appl. No.: 667,950

[22] Filed: Mar. 12, 1991

[51] Int. Cl.[5] ..... A24D 3/00

[52] U.S. Cl. ..... 131/332; 131/333; 131/335; 131/342

[58] Field of Search ..... 131/332, 333, 335, 342

[56] References Cited

U.S. PATENT DOCUMENTS

| | | | |
|---|---|---|---|
| 3,116,739 | 1/1964 | Andonie | 131/333 |
| 3,240,212 | 3/1966 | Royster | 131/333 |
| 3,339,560 | 9/1967 | Kiefer et al. | 131/332 |
| 3,463,168 | 8/1969 | Troll et al. | 131/333 |
| 3,557,801 | 1/1971 | Jamison | 131/342 |
| 3,599,646 | 8/1971 | Berger | 131/342 |
| 3,608,563 | 9/1971 | Schmitz | 131/342 |
| 4,059,121 | 11/1977 | Brackmann et al. | 131/332 |
| 4,579,130 | 4/1986 | Coffman | 131/332 |
| 4,736,755 | 4/1988 | Oldham et al. | 131/332 |
| 4,961,415 | 10/1990 | Radwanski et al. | 131/332 |

*Primary Examiner*—V. Millin
*Assistant Examiner*—Lynne Reichard
*Attorney, Agent, or Firm*—Dykema Gossett

[57] ABSTRACT

A filter cigarette is provided which has a cigarette section formed by wrapping shredded tobacco in a cigarette paper sheet and a filter section having a filter chip integrally joined to the cigarette section. The filter chip is formed by combining in a bundle at least one absorptive synthetic fiber selected from the group consisting of (1) graft polymer fibers produced from irradiated polypropylene reacted with vapor phase styrene and containing adsorptive functional groups, (2) activated carbon fibers, (3) charged electret fibers, and (4) magnetic plastic fibers and then chopping the combined fiber bundle to a predetermined length. Since the filter section does not contain adsorptive grains or particles (i.e., activated charcoal grains or particles), the integrated cigarette manufacturing plant for such filter cigarettes does not required a process or equipment for preventing the scattering of the adsorptive grains or the collection of such grains when they do escape.

13 Claims, 1 Drawing Sheet

FILTER CIGARETTE HAVING FILTER CONTAINING ABSORPTIVE SYNTHETIC GRAFT POLYMER FIBERS PRODUCED FROM IRRADIATED POLYETHYLENE REACTED WITH VAPOR PHASE STYRENE OR ABSORPTIVE SYNTHETIC MAGNETIC FIBERS

BACKGROUND OF THE INVENTION

1. Field of the Invention

The present invention relates to a filter cigarette provided with a functional filter capable of effectively adsorbing physiologically injurious substances, such as basic substances and acid substances, contained in the smoke of a cigarette, and not containing any adsorptive particles (i.e., adsorptive carbon grains).

2. Description of the Prior Art

A filter cigarette provided with a functional filter containing activated charcoal particles has been used in the prior art filters. An advanced, integral cigarette manufacturing plant for manufacturing such a filter cigarette at a high production rate must be provided with preventive processes and facilities for preventing the accidental scattering of activated charcoal particles and for preventing problems in the manufacturing processes attributable to scattered activated charcoal particles. Such preventive processes and facilities require inevitably an additional investment in equipment and facilities and increase the construction cost of the integrated cigarette manufacturing plant.

SUMMARY OF THE INVENTION

Accordingly, it is an object of the present invention to provide a filter cigarette provided with a functional filter containing no activated charcoal particles or grains and capable of effectively reducing injurious substances from the smoke of the filter cigarette.

In one aspect of the present invention, a filter cigarette is disclosed which comprises a cigarette section containing shredded tobacco and a filter section having a filter chip containing a bundle of fibers for adsorbing injurious products contained in tobacco smoke. The filter chip is produced by combining in a bundle one or more fibers from the group consisting of (1) graft polymer fibers produced from irradiated polypropylene reacted with vapor phase styrene and containing adsorptive functional groups, (2) activated carbon fibers produced by a prepreg molding process, (3) charged electret fibers, and (4) magnetic plastic fibers. The combined fiber bundle is then chopped or cut to a predetermined length (i.e., the desired length of the filter section).

Such a filter chip adsorbs radioactive polonium contained in the cigarette smoke, causes fine active particles of injurious substances contained in the cigarette smoke to aggregate in large inactive particles, and develops negative gaseous substances (air vitamins).

Since the filter chip is formed by combining or building such adsorptive fibers capable of adsorbing injurious basic and acid substances and does not contain any activated charcoal particles, the integrated cigarette manufacturing plant for manufacturing the filter cigarette of the present invention need not be provided with any facilities for preventing the scattering of activated charcoal particles and for collecting scattered activated charcoal particles, hence the facilities of the integrated cigarette manufacturing plant are simplified and, consequently, the integrated cigarette manufacturing plant can be constructed at a relatively low construction cost.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 1:
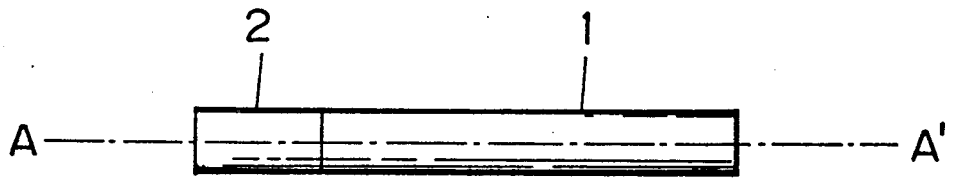
FIG. 1 is a side view of a filter cigarette in a preferred embodiment according to the present invention.
Figure 2:
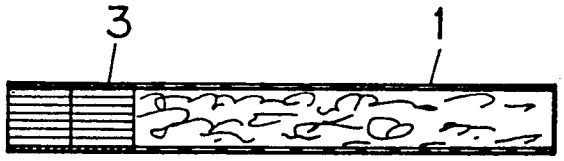
FIG. 2 is a longitudinal sectional view taken on line A—A' in FIG. 1.
Figure 3:
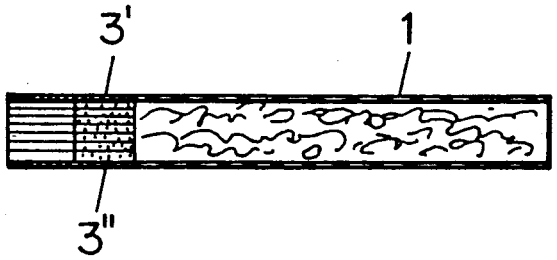
FIG. 3 PRIOR ART
FIG. 3 is a longitudinal sectional view of a conventional filter cigarette provided with a conventional filter chip containing charcoal particles.

Referring to FIGS. 1 and 2, a filter cigarette in a preferred embodiment according to the present invention comprises a cigarette section 1 formed by wrapping shredded tobacco in a cigarette paper sheet, and a filter section 2 having a filter chip 3 and integrally joined to the cigarette section 1.

The filter chip 3 of the present invention is formed by combining in a bundle at least one absorptive synthetic fiber selected from the group consisting of (1) graft polymer fibers produced from irradiated polypropylene reacted with vapor phase styrene and containing adsorptive functional groups, (2) activated carbon fibers produced by a prepreg molding process, (3) charged electret fibers, and (4) magnetic plastic fibers; and then chopping the combined fiber bundle to a predetermined length.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A filter cigarette comprising:

a cigarette section formed by wrapping shredded tobacco in a cigarette paper sheet; and a filter section having a filter chip and integrally joined to the cigarette section;

wherein the filter chip is formed by combining in a bundle absorptive synthetic graft polymer fibers produced from irradiated polypropylene reacted with vapor phase styrene and containing adsorptive, functional groups and at least one absorptive synthetic fiber selected from the group consisting of (1) activated carbon fibers, (2) charged electret fibers, and (3) magnetic plastic fibers and chopping the combined fiber bundle to a predetermined length.

2. A filter cigarette as defined in claim 1 wherein the filter chip contains (1) graft polymer fibers produced from irradiated polypropylene reacted with vapor phase styrene and containing adsorptive, functional groups and (2) activated carbon fibers.

3. A filter cigarette as defined in claim 1 wherein the filter chip contains (1) graft polymer fibers produced from irradiated polypropylene reacted with vapor phase styrene and containing adsorptive functional groups and (2) charged electret fibers.

4. A filter cigarette as defined in claim 1 wherein the filter chip contains (1) graft polymer fibers produced from irradiated polypropylene reacted with vapor phase styrene and containing adsorptive functional groups and (2) magnetic plastic fibers.

5. A filter cigarette comprising:

a cigarette section formed by wrapping shredded tobacco in a cigarette paper sheet; and a filter section having a filter chip and integrally joined to the cigarette section;

wherein the filter chip is formed by combining in a bundle absorptive synthetic magnetic fibers and at least one absorptive synthetic fiber selected from the group consisting of (1) activated carbon fibers and (2) charged electret fibers and chopping the combined fiber bundle to a predetermined length.

6. A filter cigarette as defined in claim 5 wherein the filter chip contains (1) activated carbon fibers and (2) magnetic plastic fibers.

7. A filter cigarette as defined in claim 5 wherein the filter chip contains (1) charged electret fibers and (2) magnetic plastic fibers.

8. A filter cigarette comprising:

a cigarette section formed by wrapping shredded tobacco in a cigarette paper sheet; and a filter section having a filter chip and integrally joined to the cigarette section;

wherein the filter chip is formed by combining in a bundle at least three fibers selected from the group consisting of (1) graft polymer fibers produced from irradiated polypropylene reacted with vapor phase styrene and containing adsorptive functional groups, (2) activated carbon fibers, (3) charged electret fibers, and (4) magnetic plastic fibers and chopping the combined fiber bundle to a predetermined length.

9. A filter cigarette as defined in claim 8 wherein the filter chip contains (1) activated carbon fibers, (2) charged electret fibers, and (3) magnetic plastic fibers.

10. A filter cigarette as defined in claim 8 wherein the filter chip contains (1) graft polymer fibers produced from irradiated polypropylene reacted with vapor phase styrene and containing adsorptive functional groups, (2) charged electret fibers, and (3) magnetic plastic fibers.

11. A filter cigarette as defined in claim 8 wherein the filter chip contains (1) graft polymer fibers produced from irradiated polypropylene reacted with vapor phase styrene and containing adsorptive functional groups, (2) activated carbon fibers, (3) magnetic plastic fibers.

12. A filter cigarette as defined in claim 8 wherein the filter chip contains (1) graft polymer fibers produced from irradiated polypropylene reacted with vapor phase styrene and containing adsorptive functional groups, (2) activated carbon fibers, (3) charged electret fibers.

13. A filter cigarette as defined in claim 8 wherein the filter chip contains (1) graft polymer fibers produced from irradiated polypropylene reacted with vapor phase styrene and containing adsorptive functional groups, (2) activated carbon fibers, (3) charged electret fibers, and (4) magnetic plastic fibers.

* * * * *